United States Patent [19]

Kelly et al.

[11] Patent Number: 4,714,017

[45] Date of Patent: Dec. 22, 1987

[54] PYROTECHNIC VARIABLE DELAY CONNECTOR

[75] Inventors: George G. Kelly, Hawkesbury; Henry McLaughlin, Brownsburg; James R. Simon, Lachute, all of Canada

[73] Assignee: CXA Ltd./CXA LTEE, Brownsburg, Canada

[21] Appl. No.: 45,407

[22] Filed: May 4, 1987

[30] Foreign Application Priority Data

Sep. 26, 1986 [CA] Canada ..... 519148

[51] Int. Cl.[4] ..... C06C 5/64

[52] U.S. Cl. ..... 102/275.3; 102/275.4; 102/275.11; 102/275.5; 102/275.12; 102/275.6; 102/275.7; 102/277.1; 102/318

[58] Field of Search ..... 102/318, 275.3–275.7, 102/275.11, 275.12, 277.1, 277.2

[56] References Cited

U.S. PATENT DOCUMENTS

| | | | |
|---|---|---|---|
| 1,902,706 | 3/1933 | Keese, Jr. | 102/275.6 |
| 3,205,818 | 9/1965 | Coulson | 102/275.4 |
| 3,342,133 | 9/1967 | Strom et al. | 102/275.7 |
| 3,897,731 | 8/1975 | Bowman | 102/275.5 |
| 4,424,747 | 1/1984 | Yunan | 102/275.7 X |
| 4,495,867 | 1/1985 | Mitchell, Jr. et al. | 102/275.4 |
| 4,635,734 | 1/1987 | Donovan et al. | 102/318 X |

*Primary Examiner*—Peter A. Nelson

*Attorney, Agent, or Firm*—Donald G. Ballantyne

[57] ABSTRACT

A field adjustable delay connector for use in detonating cord hook-ups for multi-charge blasting particularly adapted to work effectively with low energy shock or detonating cord. The delay connector is so constructed that the donor cord initiates combustion in a variable length of burning composition the length being mechanically adjustable by the blaster during hook-up.

7 Claims, 5 Drawing Figures

PYROTECHNIC VARIABLE DELAY CONNECTOR

The present invention relates to multiple explosive charge blasting and to the accurate timing of initiation of the charges in such blasting. More particularly, the invention relates principally to a non-electrically operated time delay connector, said connector being capable of reliably transferring an incident shock-wave from a donor shock or detonating cord to an acceptor shock or detonating cord wherein the said time delay may be varied, in the field, by a simple mechanical adjustment.

Multiple charge blasting is common in mining and construction applications where large amounts of rock are to be loosened or moved. In such blasting, the simultaneous detonation of all charges can lead to excessive ground vibrations and may decrease the effective work done by the explosive energy. Delaying the explosive initiation in successive layers, rows or individual charges can reduce the magnitude of such problems. Both electrical and pyrotechnic devices are readily available for this purpose but, in general, because of the hazards of accidental ignition by stray induced currents, the latter are preferred.

In regular multiple charge blasting, one starter cap is frequently used to initiate a hook-up or network fabricated from detonating cord connecting the main explosive charges. The delay connectors in these networks are fabricated using encased delay charges of well known exothermic slow burning compositions and may be positioned actually in the same assembly as the cap in individual charges or in the cords connecting the charges.

Regular blasting hook-ups can fail to operate as designated due to premature detonation or to failed initiations of the charges. These may sometimes be attributable to accidental failure of a delay, early firing across a delay or from cord to cord or to explosive cutting of a cord where two cords cross. The regular cord also causes a characteristic air shock-wave which is aurally offensive at considerable ranges. As a result, low energy cord containing a small fraction of the explosive loading of regular cord is becoming used increasingly frequently. A type of this cord is described in U.S. Pat. No. 3,590,739. This low energy detonating cord can be made incapable of propagating across a knot with a second cord and overcomes many of the above disadvantages. However, the low energy leads to a need for specially designed connectors and delay elements. Examples of devices are described in U.S. Pat. No. 3,987,733 disclosing an in-cord connector element; U.S. Pat. No. 4,060,034 disclosing a delay assembly for insertion between a cord and a booster; U.S. Pat. No. 4,299,167 and U.S. Pat. No. 4,248,152 disclosing delay elements for in-cord use.

Both regular and low energy cord adapted in-cord delay connectors are supplied in a preset variety of fixed delay times. This fixed nature of the delay times of existing delays causes expense and is an inconvenience since a variety must be handled and stored. Inventories must be securely kept in controlled, special conditions. An additional problem is that there are occasions where, in the adverse conditions typical of mining, an incorrect delay size may be fitted, perhaps, due to immediate lack of the correct size, or simple mistake in, for example, poor lighting conditions.

Historically, it has been possible to hand-produce delays by crimping suitable caps to appropriately cutoff lengths of lead tube encased delay composition. These delays have proved unreliable in field operations due to construction errors and possibly ingress of water.

There exists, therefore, a need for a simple and reliable field variable delay connector, capable of being used with low energy or regular detonating cords in blasting hook-ups.

Accordingly, the present invention provides a novel improved delay connector adapted for initiating a detonation wave in an acceptor cord at a preselected time interval after said connector receives a shock-wave from a donor detonating cord, said connector consisting essentially of an elongated hollowed-out body comprising a first attachment means for firmly holding said donor detonating cord, an exothermically burning delay composition located within said hollowed-out body, an explosive transfer charge abutting said delay composition and second attachment means for firmly holding said acceptor detonating cord in initiation relationship with said transfer charge and characterized in that said elongated hollowed-out body has a plurality of lightly sealed notches extending from the surface of the body to expose to initiation the delay composition, said notches being spaced at a variety of distances from the transfer charge and said first attachment means being adapted to bring said donor detonating cord into initiation relationship over a selected one of said notches.

As described below, the donor cord attachment is passive in the reverse sense. A detonation signal in the donor cord is transmitted to the acceptor but not, should it happen, from acceptor to donor. Such a delay device is said to be unidirectional. Reverse transmission of a signal or a bidirectional delay may be constructed with a suitable transfer or booster charge being in-built into the above donor attachment device. Bidirectional delays are considered useful insurance against failures in some blasting applications but, in others, are considered to introduce unnecessary hazard and the unidirectional configuration, as shown, is often preferred.

So that the invention may be better understood, preferred embodiments will now be described, by way of example only, with reference to the accompanying drawings wherein.

By detonating cord is meant principally low energy detonating cord but, if necessary, minor adaptations of the attachment means above can be made to accommodate the different sizes of cord including regular detonating cords.

Figure 1:
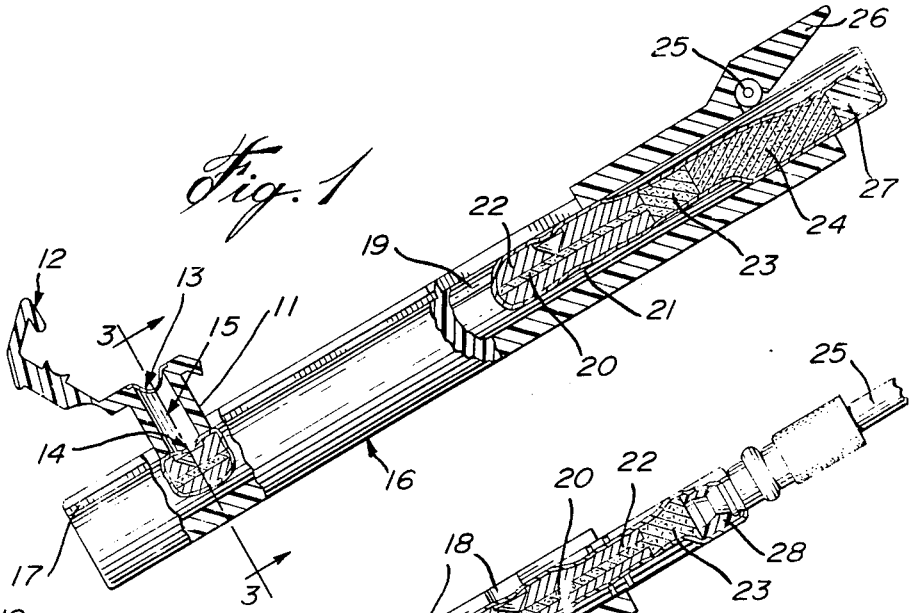
FIG. 1 shows a partly cut-away side elevation of a variable delay connector in accordance with the invention.
Figure 2:
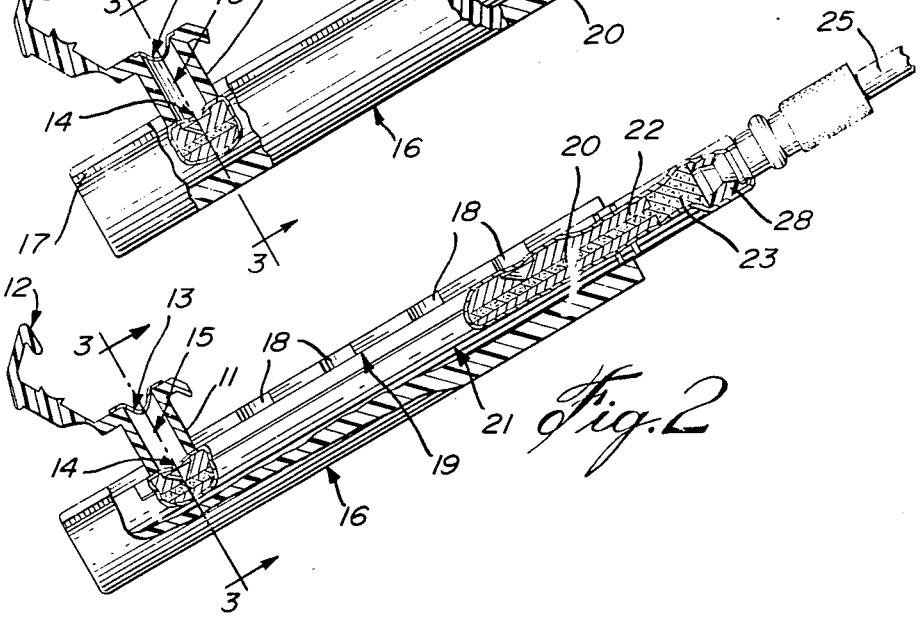
FIG. 2 is a partly cut-away side elevation of the delay connector with a differing acceptor detonating cord attachment means.
Figure 3:
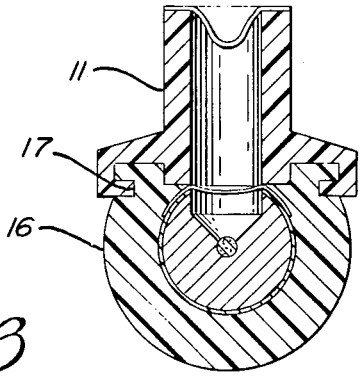
FIG. 3 is a section on line 3—3 of FIGS. 1 and 2.

Referring particularly to FIGS. 1 to 3, there is shown a donor cord attachment device 11 having a snap-down grip 12 adapted to hold the cord transversely and in contact with moisture seals 13 and 14 enclosing air gap 15. This whole attachment device 11 may slide along plastic body 16 of the delay connector on track 17. By means of a small raised portion (not shown) on the attachment 11 and a number of small indentations (not shown) on track 17, "positive" location of the attachment can be obtained over any of the notch positions 18 which expose, under aluminized tape waterproofing 19, the delay composition charge 20. The notched positions 18 are preformed by drilling out the aluminum tube 21 and lead tube 22 protecting the delay charge before insertion of the metal encased parts into the plastic body. The delay connector is also provided with a transfer charge of heat detonable explosive 23, such as, lead azide and a small booster charge of high explosive 24, where needed, to assure propagation of the detonation into acceptor cord 25. In the embodiment shown in FIG. 1, the acceptor cord 25 is placed transversely in clip 26 which is an integral part of the plastic body 16. End closure cap 27 retains the charges in place. The embodiment in FIG. 2 shows an end on abutted attachment of acceptor cord 25. The cord is gripped by the swaged on plastic seal 28 which fits inside the aluminum tube 21. This embodiment is supplied with a variety of lengths of preattached acceptor low energy cords.

Figure 4:
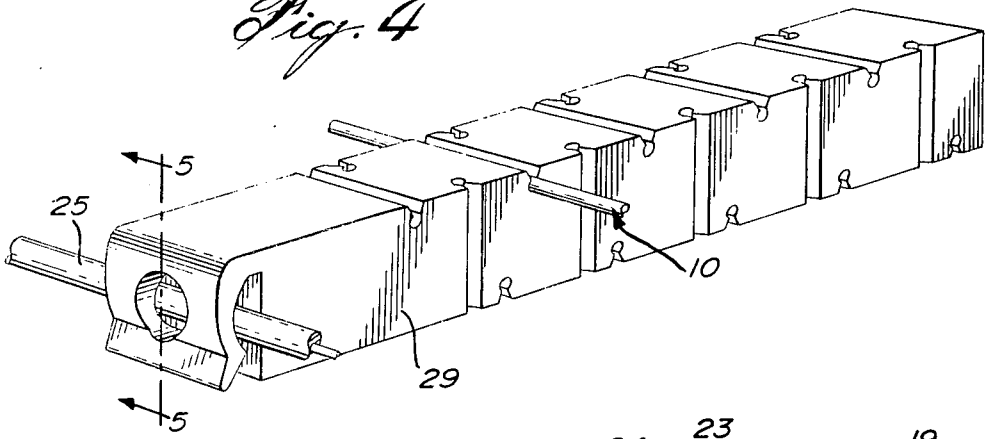
FIG. 4 is an isometric view of the delay connector showing alternate donor detonating cord attachment means.
Figure 5:
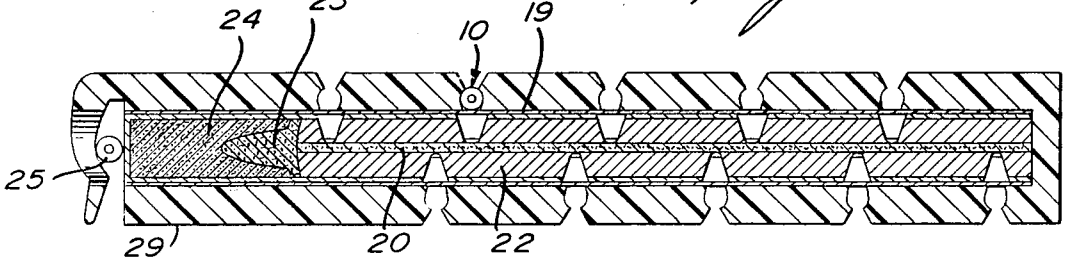
FIG. 5 is a section on line 5—5 of FIG. 4.

The embodiment shown in FIGS. 4 and 5 shows acceptor cord 25 being held in place on a differently formed plastic body 29. This body is so designed that a plurality of attachment positions are formed in the body thus removing the need for slidable attachment 11 of the embodiments shown in FIGS. 1 to 3. This embodiment also differs in that notches with donor attachment points are provided in four different orientations around the long axis of the delay charge allowing fine adjustment of delay times through the provision of more attachment points.

In actual operation, an incident shock-wave is provided in the donor cord. This ignites the delay charge at the selected donor attachment site by firing through the moisture seal or seals. The delay composition then commences burning in two directions, one harmlessly away from the acceptor cord end, the other eventually, after the appropriate time, reaching the heat sensitive explosive. On detonation, this charge and the small booster charge where fitted, transmit the detonation into the acceptor cord.

Selection of the delay period is obtained by provision of delay compositions of a suitable burning rate and a length of delay charge corresponding to the longest delay period requirement. Shorter delay periods can then be obtained by attaching the donor cord 10 at intermediate positions by means of the series of attachment points in the specially formed plastic casing 29 as shown in the embodiment in FIGS. 4 and 5 or, alternatively, by sliding the donor cord attachment device 11 along the track 17 in the plastic casing 16 as shown in the embodiment in FIGS. 1, 2 and 3.

The attachment means of the invention are most conveniently fabricated using deformable, naturally spring loaded plastic clips, which clips are integral parts of the elongated body enclosing the delay composition. Attachment of cords may also be accomplished by other well known means, such as the crimping of the elongated body over an abutted end of a cord.

By exothermically burning delay composition is generally meant a regular delay composition, such as, a red lead and silicon mixture contained in a lead tube. Such a mixture is ignitable directly by the shock delivered by detonated low energy cord but a small charge of other sensitive explosive, such as, lead azide may be introduced between the donor cord and the delay composition if needed.

Reliable initiation of an acceptor cord from the delay connector often requires the shock effects of a small charge or charges of explosive which are initiated by the burning delay composition. Such charges are located adjacent the delay composition.

The elongated hollowed-out body of the connector generally fits over a small diameter cylindrical charge of delay composition. This charge of the composition fills a continuous axial cavity at the centre of a lead or other soft metal tube this tube itself being closely enclosed in a reinforcing stronger tube fabricated, for example, in aluminum. The thus enclosed delay composition is then housed in a further enclosing plastic body which body provides the attachment means for the cords. By initiation relationship is meant that the size and nature of the transfer charge and the separation of the acceptor cord from said charge are selected so burning in the delay charge reliably sets off the transfer charge and acceptor cord. The plurality of notches provides a plurality of points at any one of which the donor cord detonation may set the delay charge burning. By notch is meant an indentation where the reinforcing tube and the soft metal tube have been cut-away to expose the delay charge. Such perforations must be sealed using waterproof tape for effective operation. The selection of a particular notch at a particular position provides a selected length of delay charge to burn before initiation of the transfer charge. (The delay composition is set burning in two directions the one away from the acceptor cord end being harmlessly redundant and the one burning towards the acceptor cord providing for the operation of the delay).

The preferred embodiments above serve as unidirectional delays. It will be clear to those skilled in the art that the provision of small charges of heat detonable explosive near the donor ignition points and of nearby small booster charges can provide bidirectional capability should this be required.

It will also be clear to those skilled in the explosives accessory arts that this same variable delay concept could be adapted for use with an electric donor signal by using an electrically actuated fuse head as the donor stimulus.

In order to demonstrate the utility of the delay, test units were made as follows:

(a) a length of silicon delay composition jacketed in a lead tube was inserted into a conventional detonator tube;

(b) the delay connector was pressed and crimped to hold it in position;

(c) holes were drilled through the tube wall and lead jacket at 0.5 inch intervals exposing the delay composition;

(d) the drilled holes were covered using an adhesive aluminum tape;

(e) an ignition charge and low energy cord were positioned against the delay connector and secured; and (f) a connector designed to accept a donor such as detonating cord and low energy cord was attached to the detonator tube in such a way that it could be positioned over any one of the pre-drilled holes.

A sample of fifty of the above experimental units was assembled and tested for reliability and accuracy of performance. All fifty of the experimental units transmitted the detonation signal from donor to acceptor cord whether the acceptor was standard low energy, hollowed-out shock cord having 18 milligrams per meter of HMX based explosive (HMX is also known as octogen or, more correctly, cyclotetramethylenetetranitramine) or regular low energy detonating cord having 1.0 grams per meter of PETN (pentaerythritol-tetranitrate). The relationship between delay time and separation of the donor cord attachment from the transfer charge was found to be linear and variations in the actual time were shown to be within acceptable limits. The Table of results below shows the actual results obtained.

TABLE

| Separations of Donor/Acceptor Locations Inches | Number of Samples | Average Delay Milliseconds | Coefficient of Variation %* |
|---|---|---|---|
| 0.500 | 10 | 68.3 | 6.2 |
| 1.000 | 10 | 137.2 | 2.8 |
| 1.500 | 10 | 205.4 | 2.4 |
| 2.000 | 10 | 279.2 | 1.8 |
| 2.500 | 10 | 345.1 | 5.3 |

*Note:
By coefficient of variation is meant the ratio of standard deviation of the mean times of delay for 10 sample groups, divided by the mean delay time of that particular group. Standard deviation was calculated using the regular formula, for example, as in "Tables of Physical and Chemical Constants" by G. W. C. Kaye et al, Longman, 1973, Page 369.

We claim:

1. A pyrotechnic delay connector adapted for initiating a detonation wave in an acceptor cord at a variable time interval after said connector receives a shock wave for a donor device, said time interval being adjustable at the blast site and wherein said connector consists essentially of an elongated, hollowed-out body comprising a first attachment means for firmly holding said donor device, an exothermically burning delay composition located within said hollowed-outed out body, an explosive transfer charge abutting said delay compositon and second attachment means for firmly holding said acceptor detonating cord in initiation relationship with said transfer charge and characterized in that said elongated hollowed-out body has a plurality of lightly sealed notches extending from the surface of the body to expose to initiation the delay composition, said notches being spaced at a variety of distances from said transfer charge and said first attachment means being adapted to bring said donor detonating cord into initiation relationship over a selected one of said notches.

2. A delay connector as claimed in claim 1 wherein said first attachment means comprises a formed plastic assembly holding said donor device in movable engagement with said body and said movable engagement providing freedom to select from a range of positions allowing initiation relationship with said delay charge.

3. A delay connector as claimed in claim 1 wherein said attachement means comprises a selected one of a series of formed openings in said body, each opening being capable of holding said donor device in initiation relationship with said delay charge.

4. A delay connector as claimed in claim 2 wherein said acceptor cord is attached in end on abutment and in initiation relationship to said transfer charge.

5. A delay connector as claimed in claim 2 wherein said acceptor cord is attached and retained in transverse orientation and in initiation relationship to said body by means of a clip.

6. A delay connector as claimed in claim 3 wherein said acceptor cord is attached in end on abutment and in initiation relationship to said transfer charge.

7. A delay connector as claimed in claim 3 wherein said acceptor cord is attached in transverse orientation and in intiation relationship to said transfer charge by means of a clip.

* * * * *